US009248621B2

(12) United States Patent
Schmett et al.

(10) Patent No.: US 9,248,621 B2
(45) Date of Patent: Feb. 2, 2016

(54) APPARATUS AND METHOD FOR THE INSERTION OF FILMS IN TABLET PRESSES

(71) Applicant: Korsch AG, Berlin (DE)

(72) Inventors: Michael Schmett, Potsdam (DE); Stefan Mies, Berlin (DE); Wolfgang Korsch, Berlin (DE)

(73) Assignee: KORSCH AG, Berlin (DE)

( * ) Notice: Subject to any disclaimer, the term of this patent is extended or adjusted under 35 U.S.C. 154(b) by 0 days.

(21) Appl. No.: 14/403,582

(22) PCT Filed: May 16, 2014

(86) PCT No.: PCT/EP2014/060130
§ 371 (c)(1),
(2) Date: Nov. 25, 2014

(87) PCT Pub. No.: WO2014/184364
PCT Pub. Date: Nov. 20, 2014

(65) Prior Publication Data

US 2015/0125242 A1 May 7, 2015

(30) Foreign Application Priority Data

May 16, 2013 (DE) ..... 10 2013 105 051
Jul. 11, 2013 (EP) ..... 13176062

(51) Int. Cl.
*B30B 15/30* (2006.01)
*B30B 11/34* (2006.01)

(52) U.S. Cl.
CPC ..... *B30B 15/30* (2013.01); *B30B 11/34* (2013.01)

(58) Field of Classification Search
CPC ..... B30B 11/34; B30B 15/30; B29C 43/18; B29C 2043/181; B29C 2043/182; B29C 31/008
USPC ..... 425/126.1; 198/341.07; 414/222.02
See application file for complete search history.

(56) References Cited

U.S. PATENT DOCUMENTS

| | | | | |
|---|---|---|---|---|
| 2,946,298 | A * | 7/1960 | Doepel et al. | 264/275 |
| 2,992,729 | A * | 7/1961 | Curtius | 209/563 |
| 3,796,327 | A * | 3/1974 | Meyer et al. | 414/222.02 |
| 3,836,299 | A | 9/1974 | Houston et al. | |
| 3,960,292 | A * | 6/1976 | Knapp | 221/211 |
| 5,088,915 | A | 2/1992 | Korsch et al. | |

(Continued)

FOREIGN PATENT DOCUMENTS

| | | | |
|---|---|---|---|
| DE | 102007039043 | A1 | 2/2009 |
| EP | 0349777 | A1 | 1/1990 |

(Continued)

*Primary Examiner* — Robert B Davis
(74) *Attorney, Agent, or Firm* — Joyce von Natzmer; Agris & von Natzmer

(57) ABSTRACT

The invention relates to a device for transferring, depositing and positioning films that are used as cores in coating-core tablets, in matrices of tablet presses, said device comprising at least three modules, a. module 1 (11) comprising at least one storage unit that contains the films, and/or at least one supply unit that supplies the films for transfer by a second module, b. module 2 (12) comprising at least one transfer unit, at least one conveyor belt (17) and at least one intake wheel (22), c. module 3 (13) comprising at least one controllable vacuum head (25) which comprises a removal device that removes the films from the carriers (28) of module 2 (12) using a vacuum and deposits them in the matrices of the tablet press (14).

18 Claims, 6 Drawing Sheets

(56) References Cited

U.S. PATENT DOCUMENTS

Figure 1:
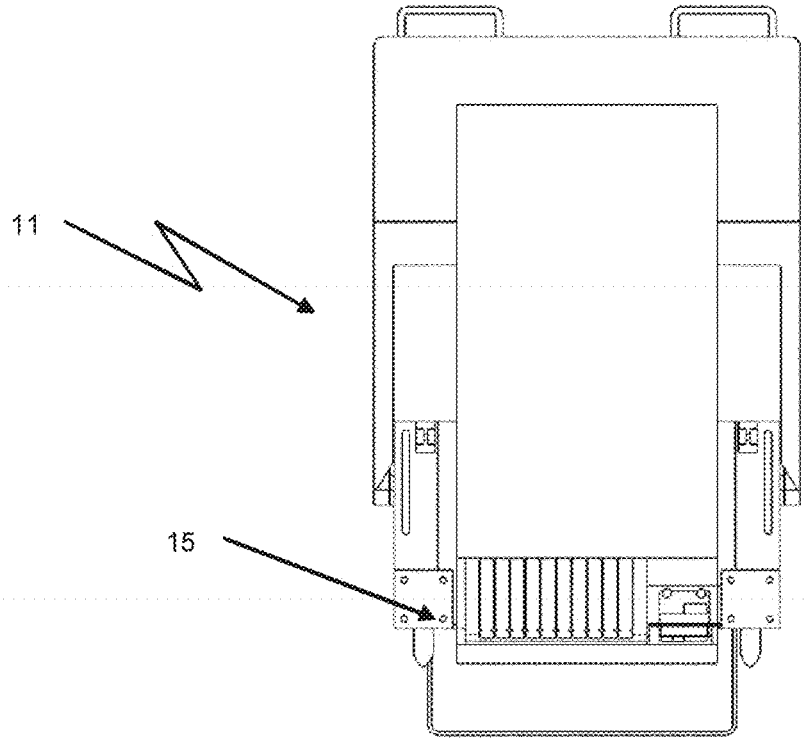

| | | | | |
|---|---|---|---|---|
| 7,648,353 | B2 | 1/2010 | Meier et al. | |
| 7,811,488 | B2 * | 10/2010 | Ozeki et al. | 264/113 |
| 8,062,015 | B2 * | 11/2011 | Sanderson | 425/126.1 |
| 2009/0260212 | A1 | 10/2009 | Schmett et al. | |
| 2010/0181705 | A1 | 7/2010 | Schateikis et al. | |

FOREIGN PATENT DOCUMENTS

| | | | |
|---|---|---|---|
| EP | 1944002 | A2 | 7/2008 |
| EP | 2036707 | A2 | 3/2009 |
| EP | 2110232 | A2 | 10/2009 |
| JP | H09271996 | A | 10/1997 |
| KR | 101164775 | B1 * | 7/2012 |

* cited by examiner

APPARATUS AND METHOD FOR THE INSERTION OF FILMS IN TABLET PRESSES

CROSS-REFERENCE TO RELATED APPLICATIONS

This is the U.S. national stage of International application PCT/EP2014/060130, filed May 16, 2014 designating the United States and claiming priority to German application DE 10 2013 105 051.4, filed May 16, 2013 and European application EP 13176062.1, filed Jul. 11, 2013.

The invention relates to a take-over and positioning device and to a method for being able to place a film, which is used as a core for a sheathed-core tablet, in the die of a tablet press.

The prior art describes rotary tablet presses, for example for the pharmaceutical industry, by means of which standard single-layer tablets, multi-layer tablets and/or sheathed-core tablets can be produced. In particular, the production of sheathed-core tablets is highly complicated since a tablet has located in it a second tablet, which is known as a core.

The tablet presses suitable for the production of sheathed tablets have in the sheathed-core version, on the reference circle of the die plate of a tablet press, not only one, but, in particular, two filling appliances for powder. These two powder filling appliances contain the powder with which the core of a sheathed-core tablet is sheathed.

In order to achieve such sheathing, between the two powder filling appliances of the tablet press a core module is located, via which the prefabricated cores to be sheathed are introduced individually into the die of a rotary tablet press. The cores to be sheathed are conventionally fed to the core module as bulk material.

The actual pressing operation for the production of sheathed tablets takes place in that, first, powder is poured into the die of the tablet press via the first powder filling appliance, and then the core to be sheathed is introduced into the die by means of the core module. The inserted core is covered with powder by means of the second powder filling appliance, the powder is finally compacted as a result of the last pressing operation, and a solid envelope, what is known as the sheath, is thereby generated around the core.

During the production of the sheathed-core tablet, the pressure force upon each individual sheathed-core tablet is monitored. Should no core or only parts of a core have been inserted, the pressure force falls below the lower check limit, and the tablet is recognized as defective and is sorted out automatically via a pneumatic switch. It can thereby be ensured that every sheathed-core tablet also actually has a core.

EP 2 110 232 A2 describes a method and an apparatus for the insertion of cores in dies of a rotary tablet press. In this case, a feed chain for the cores of sheathed-core tablets is described, which is composed of a core separator, of a core feed device and of a core distributor. In this case, the cores to be inserted into the dies are fed to the core feed device via the core separator and are introduced into orifices on a rotatable conveyor. The cores are transported to the core distributor by means of this conveyor, the guide surface, on which the rotatable conveyor lies, being interrupted in the region of the core distributor, so that the cores located in the orifices fall downward and are picked up by gripping elements of the core distributor which are designed as grip tongues. The grip tongues transport the cores into the region of the rotor of the rotary tablet press, where they are deposited into a die at the overlap point of the reference circle of the die plate of the rotary press and of the reference circle of the rotatable conveyor. The disadvantage of the apparatus described in EP 2 110 232 A2 is that, according to this invention, no sensor check of the cores is carried out before they are deposited into the die.

Further, the apparatus described in EP 2 110 232 A2 and the method described there are not suitable for processing films as inserts of a sheathed-core tablet to be produced. Films in the context of this invention are preferably information carriers, separating layers or active substance carriers which are lightweight, flexurally slack, pliant, flexible, rigid and/or electrostatically chargeable. They have a diameter of approximately 3 to 20 mm and a preferred thickness of 0.1 to 0.5 mm. It may be gathered from these features that the apparatus described in EP 2 110 232 A2, by virtue of its design, is unsuitable for transporting these films or for depositing them reproducibly into the dies of the rotary tablet press at the required speed.

EP 2 110 232 A2 is aimed, further, at the feed of the cores from an indeterminate quantity, which may be implemented, for example, by means of bulk material feed. Such a method is out of the question for films in that, because of the electrostatic charge, they would as a bulk material, for example, stick together or, on account of their flexural slackness, would not be grasped by the grip tongues of the core distributor. Furthermore, films, as core inserters, require individual guided transport which does not give the individual film any degree of freedom for leaving the production region of the rotary tablet press by means of air vortices or other disturbances. The core feed device with the orifices through which the cores fall to the core distributor in the transfer region does not fulfill this requirement.

EP 0 349 777 A1 describes a sheathed-core press for the production of sheathed tablets, in which core rams, as they are known, are provided, by means of which tablet cores are deposited into a die into the first powder layer of a tablet to be pressed. For transferring the cores, EP 0 349 777 A1 makes use of movable arms. This is intended to achieve the object of introducing the cores into the powder layer in an exactly centered manner, particularly when the die table rotates at a high rotational speed. The disadvantage of the sheathed-core press described in EP 0 349 777 A1 is that the core feed and the transfer of the cores to the movable arms are not suitable for the use of flexible, flexurally slack films.

The object of the present invention, therefore, is to provide an apparatus and a method which do not have the disadvantages and deficiencies of the prior art and which offer a solution, in particular, for sheathing flexible shaped bodies which have not hitherto been accessible as a core for a sheathed-core tablet.

The object is achieved by means of the independent claims. Advantageous embodiments arise from the subclaims.

In a preferred embodiment, the invention relates to an apparatus for the transfer, for the insertion and for the positioning of films, which are used as cores for a sheathed-core tablet, in dies of tablet presses, the apparatus comprising at least three modules, a. module 1, comprising at least one storage unit, which contains the films, and/or at least one provision unit, which provides the films for take-over by a second module,
b. module 2, comprising at least one take-over unit, at least one conveyor belt and at least one intake wheel, module 2
   i. taking over the films from module 1 by means of a pick-up element,
   ii. placing the films on carriers,
   iii. transporting the carriers,
   iv. checking the loading of the carriers by means of imaging sensors and/or detecting the number of carriers in a section of a conveyor belt by means of counter sensors, faulty non-loaded carriers being sorted out onto a conveyor belt 2 and being delivered for new loading with films, v. setting a spacing between the carriers by means of the intake wheel, c. module 3, comprising at least one controllable vacuum head comprising an extraction device which extracts the films from the carriers of module 2 by means of a vacuum and inserts them into the dies of the tablet press.

Figure 5:
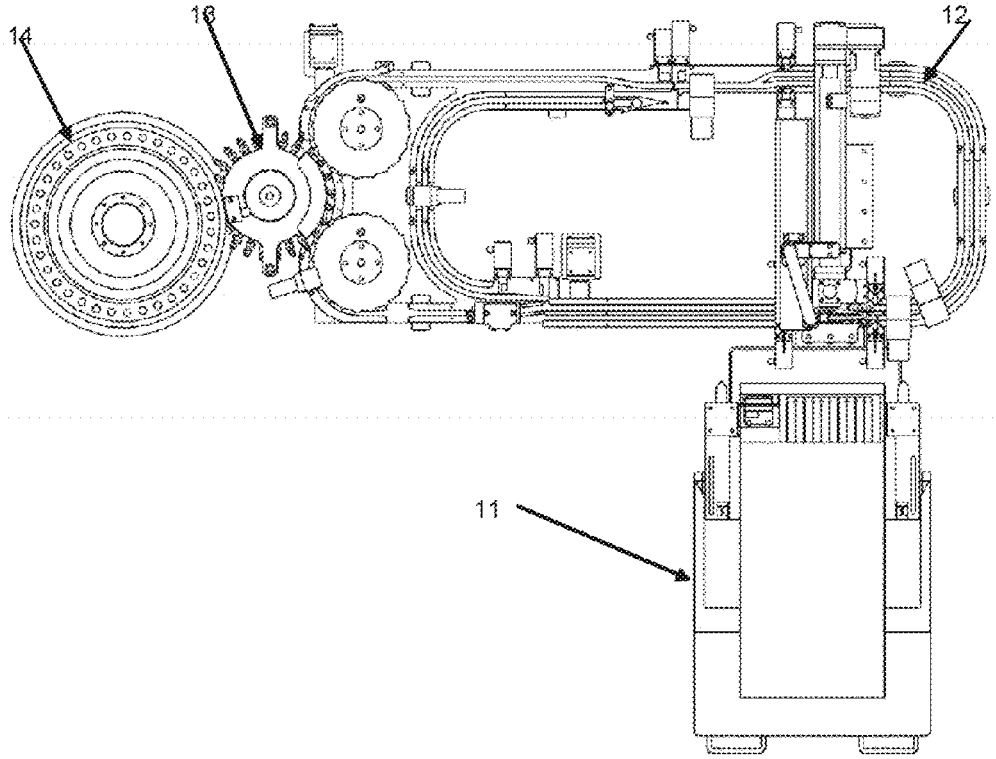

An exemplary embodiment of the apparatus is shown in FIG. 5. FIG. 5 shows how the modules 1, 2 and 3 interact. The apparatus is, in particular, computer-controlled and comprises suitable drives in order to ensure the functionality of the modules, so that the apparatus and the method of the present invention are, in particular, controllable automatically. Module 1 comprises, in particular, a storage magazine for films, the films being packaged individually. It turned out to be advantageous if module 1 is suitable for providing the films to be sheathed, such that the films can be taken over individually. For this purpose, module 1 comprises a storage magazine in which, however, the films are not provided, as in the prior art, as bulk material, but instead are packaged individually. This may take place, for example, via a long carrier strip comprising shaped depressions in which the films are located. The depressions on the carrier strip are covered with a protective film, in particular for storage and transport purposes. The carrier strip may, for example, be rolled up. Module 1 preferably comprises a possibility for receiving a plurality of rolls with carrier strips. Further, by means of module 1, the carrier strip can be transported manually or automatically and unrolled and the films unpacked, so that the films can be extracted individually from the depressions. Extraction takes place, in particular, by means of module 2. It is advantageous that this type of provision of films by means of module 1 can take place automatically and, selectively, discontinuously or continuously, in order thereby to allow a reproducible provision of films.

Figure 2:
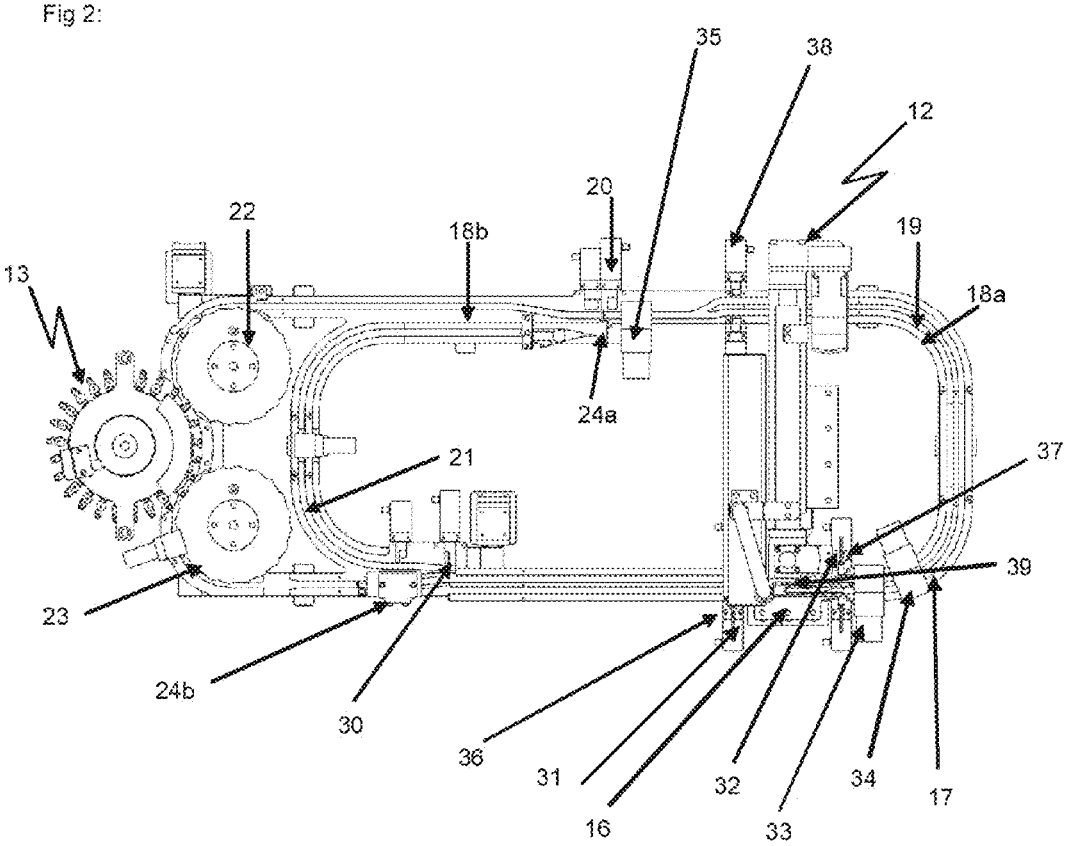

It is preferable that module 2 comprises the following units which are selected from the group comprising take-over units, pick-up elements, conveyor belts, deflecting wheels, guide rails, spacers, stoppers, imaging sensors, counter sensors, intake wheels, output wheels and/or switches. The designation "deflecting wheels" comprises, in particular, intake wheels and/or output wheels. An exemplary embodiment of module 2 is shown in FIG. 2. This FIG. 2 also shows the interaction of the take-over units, conveyor belts, imaging sensors, counter sensors, intake wheels, output wheels and switches. For the take-over of films from module 1, module 2 comprises essentially the take-over unit which comprises as a pick-up element a "pick and place" unit which is equipped, in particular, with vacuum heads in order to suck up the films. It is preferable that the take-over unit of module 2 comprises as a pick-up element up to 50 vacuum heads, preferably up to 30 vacuum heads, more preferably up to 20 vacuum heads and most preferably up to ten vacuum heads. Of course, for example, five vacuum heads or one vacuum head may also be used.

It is preferable, in particular, that the films which are provided by module 1 are provided in a clocked or discontinuous manner. Further, it is especially preferable if the take-over of the films by module 2 also takes place in a clocked or discontinuous manner. It was entirely surprising that a rotary press can be provided, in which the modular components interact in such a way that a clocked pick-up and take-over of the films in the first production stages, as is required by virtue of the nature of the films, can be converted into a continuous feed into the pressing region of the rotary press, as is implemented in conventional presses.

It is advantageous, further, if module 2 comprises two flexible conveyor belts with deflecting wheels. The conveyor belts are flexible and can receive, for example, about 300 carriers. The films are transported on the conveyor belt by means of the carriers to module 3 (take-over and press-in module). The guide rails of module 2 are designed such that the carriers, when being transported, can be kept in track. Automatic stoppers prevent an uncontrolled build-up of carriers which are controlled by various sensors. In particular, module 2 comprises imaging sensors, which are preferably configured as cameras, and counter sensors, which preferably constitute initiators. An average person skilled in the art knows which type of sensors can be used for determining a number of articles or as imaging sensors. The imaging sensors check the loading of the carriers during transport, in each case a camera being available for checking a conveyor belt. Checking the loading of the carriers by means of imaging sensors is especially advantageous, since the lightweight flexurally slack films are appreciably more difficult to handle than solid cores.

These imaging sensors are provided, in particular, after the take-over of the films onto the carriers in module 1 and after the convergence of the two conveyor belts. The sensor provided in this region determines, in particular, which carriers are locked out by means of a switch and transferred onto a conveyor belt 2 which does not lead to module 3, but instead the locked-out carriers are delivered for new loading with films by module 1. This conveyor belt 2 is also designated in the context of the invention as a bypass. It was entirely surprising, because of the optical properties of the films, that an optical sensory check of the loading of the carriers with films can be provided.

Further, module 2 comprises counter sensors which are suitable for determining the number of articles, here the carriers, which are led past. Such counter sensors are used, in particular, in the transfer region between module 1 and module 2. By means of module 1, preferably ten films are provided in a transfer operation. In order to take over these ten films, ten carriers have to be provided, which make the films transportable as carriers. The use of carriers is especially advantageous, since the transport of the films could not be carried out without assisting devices, such as, for example, the carriers as carriers.

In order to provide ten carriers in the transfer region between module 1 and module 2, a stopper, which interacts with a counter sensor at the end of the transfer region, is closed. A stopper in the context of this invention is a device which can move in between the transport flow of the carriers and stop these. A stopper according to the invention is controlled in each case by means of a counter sensor. When the stopper has stopped the continuous flow of carriers at the end of the transfer region, a counter sensor, which is provided at the start of the transfer region, counts the number of carriers arriving and moving into the transfer region. The terms "start" and "end" of the transfer region are to be understood in relation to the direction of transport of the carriers on the transport circulation circle. The transport of the carriers on the conveyor belt takes place counterclockwise, so that the start of the transfer region between module 1 and module 2 is the region in which the carriers move into the transfer region. The stopper located there is designated in the context of this invention as the front stopper. The end of the transfer region in the context of the invention designates the region in which the carriers leave the transfer region. The stopper located there is designated in the context of this invention as the rear stopper.

If the counter sensor at the start of the transfer region detects that ten carriers have moved into the transfer region, the stopper interacting with this counter sensor closes the transfer region so that no further stoppers can move in. The carriers are then loaded with the films by means of the "pick and place" unit. When this operation is terminated, the stopper at the end of the transfer region is opened and the carriers can be transported away on the conveyor belts.

It is especially preferable if the films are picked up by module 2 by means of a pick-up element and vacuum heads. In particular, the use of vacuum heads subjected to underpressure or a vacuum enables the films to be handled as cores for sheathed-core tablets.

Shortly after the opening of the stopper at the end of the transfer region, the front stopper is also opened. As a result of this time delay, it is possible to give rise in the advantageously continuous flow of carriers to a gap into which the rear stopper can move and stop the stream of carriers. In the context of this invention, this operation is designated as "making a gap". The front stopper moves into the standstill between a tenth and eleventh carrier. The term "sensory check" is to be understood in the context of the invention not to mean checking the carriers or films by taste or feel, but instead a check of the loading of the carriers with films, the presence of these being checked. Further sensors are provided in order to detect the number of carriers moved past. That is especially advantageous, since the clocked take-over of the films in the transfer region of module 1 and module 2 into a continuous feed of the carriers for module 3 can thereby be made possible.

By means of, for example, two switches, in particular, the two conveyor belts are connected to one another and the direction of the carriers located on the conveyor belt is controlled. In a preferred embodiment of the invention, the rotation of the rotary press is counterclockwise. Preferably, module 2 comprises a capacity for 5000 carriers, preferably for 2500 carriers, more preferably for 1000 carriers and most preferably for 300 carriers. Of course, for example, even only 50 carriers may be used. It is also preferable that the carriers comprise reception bores for centering the films. It was surprising that, as a result of the interaction of the various units of module 2, transport which takes place reproducibly can be implemented. By virtue of the, in particular, automatic sequence, a controlled method can be made available in order to make sensitive shaped bodies accessible to automatic further processing. Module 2 is suitable, particularly by virtue of the modular type of construction and the flexible conveyor belt of variable length, for adapting the required throughput individually. The variability and flexibility of the present invention, particularly during the transport of sensitive films to be inserted individually, for implementing large quantities was entirely surprising.

It is preferable, further, that module 3 comprises controllable vacuum heads, movable arms, at least two control cams, compressed air connections and/or vacuum connections, the vacuum heads being lowerable and penetrating into dies of the tablet press. Preferably, the vacuum heads of module 3 are designed as take-over/transfer heads which, as a component of module 3, take over films from module 2 and constitute an extraction device. In this case, the vacuum heads, as an extraction device, take over the films from the carriers of module 2 by means of a vacuum. This takes place, in particular, by subjecting the vacuum heads to underpressure. In particular, the vacuum heads of module 3 are designed to be controllable. Furthermore, the vacuum heads, as a component of module 3, constitute an insertion unit which inserts or transfers the films taken over from module 2 into the dies of the tablet press.

Figure 3:
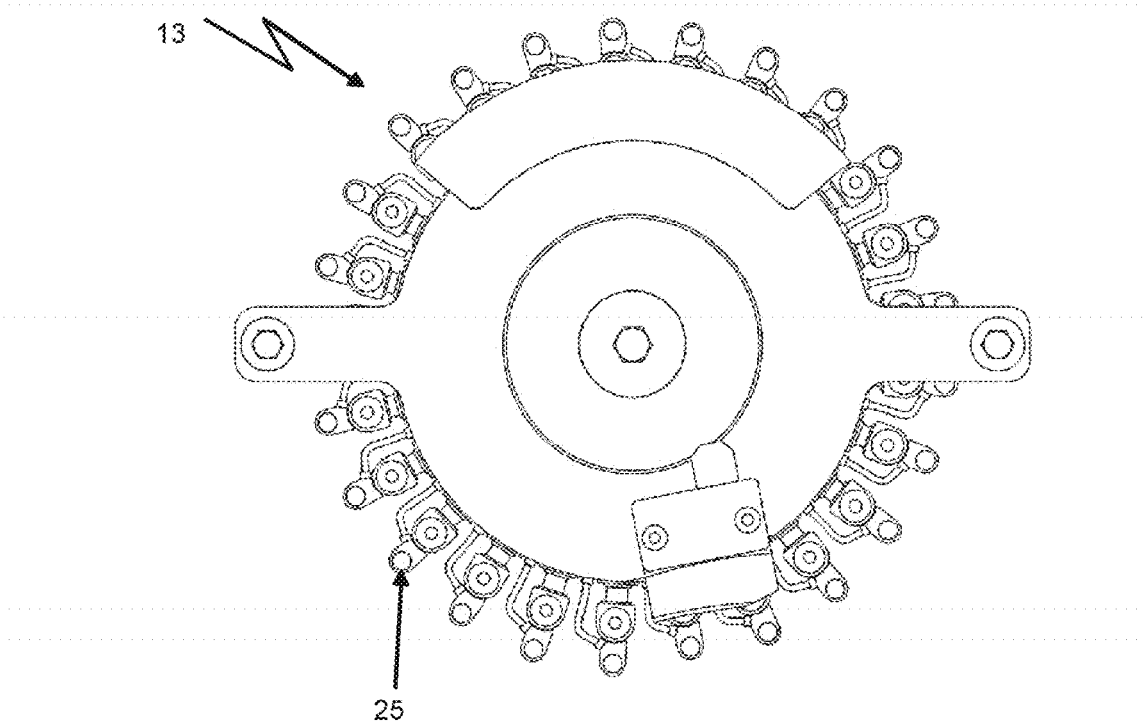

Moreover, it is preferable that the rotational speed of module 3 can be set variably and synchronously with the rotor speed of the tablet machine. Module 3 takes over the films from module 2. Module 3 is capable, by virtue of the vacuum heads, of sucking up the films from the carriers. On account of the identical rotational speeds of module 3 and of the rotor of the tablet machine, the identical rotational speeds being designated in the context of the invention as synchronous operation, a controllable transfer of the films into the die orifices of the tablet machine can take place. FIG. 3 shows an exemplary embodiment of module 3. FIG. 2 shows how modules 2 and 3 interact. The accuracy and reproducibility with which the films can be inserted individually into the die orifices of the tablet machine were surprising. Surprisingly, for example, conventional tablet machines can interact with the present invention. As a result, the invention is of versatile use and can be individually coordinated with the most diverse possible requirements, for example, with regard to throughput and speed.

In a further preferred embodiment, the invention relates, in particular, to a method for the transfer, for the insertion and for the positioning of films, which are used as a core for sheathed-core tablets, in dies of tablet presses, the method comprising the following method steps:

a. Provision of the films by means of module 1 which brings the films into the take-over position,
b. Provision of ten carriers in the transfer region of module 1 as a result of the interaction of counter sensors and stoppers,
c. Take-over of the films by module 2, module 2 receiving the films by a pick-up element by means of vacuum heads,
d. Placing of the films on carriers by module 2, the films being centered on the carriers,
e. Transport of the carriers to module 3, the loading of the carriers being checked in a sensory manner by imaging sensors,
f. Take-over of the films by module 3 by means of vacuum heads,
g. Positioning of the films in the dies of the tablet press, the films being inserted.

Preferably, the films are inserted into the dies essentially centrically. It is preferable if the films are an information carrier, a separating layer and/or an active substance carrier, the films being lightweight, flexurally slack, pliant, flexible, rigid and/or chargeable. Moreover, it is preferable that the films have all conceivable shapes and, for example, are round, angular, oval or asymmetric. The films have, in particular, a diameter of 1 mm to 20 mm, preferably of 1 mm to 15 mm, more preferably of 1 mm to 10 mm and most preferably of 1 mm to 5 mm. The films may have a thickness of 0.1 mm to 10 mm, preferably of 0.1 mm to 5 mm, more preferably of 0.1 mm to 1 mm and most preferably of 0.1 mm to 0.5 mm. It was entirely surprising that the present invention affords many different possibilities for making the most diverse possible shaped bodies accessible for tableting which hitherto have not been able to be processed in or into a tablet.

The films comprise as material, in particular, plastics, but the present invention also embraces natural substances, composite materials, metals or else mixtures or alloys, for example, as material. The films may constitute a single-component or multicomponent system. The films have, for example, a homogeneous nature and they may have a smooth or rough surface and/or be composed of particulate material. It is also preferable if the films are composed of a soluble material which dissolves upon contact with liquids, for example, in the stomach or intestinal tract. The films may also contain a pharmaceutical active substance which, for example, is released during the dissolution or disintegration of the film.

Very small solid particles may be embedded both in insoluble films and in soluble films. These solid particles may have a size of 0.5-50 $mm^3$. It is preferable, further, if the particles have a diameter which is smaller than 20 mm, preferably smaller than 10 mm, more preferably smaller than 5 mm and most preferably smaller than 1 mm. The particles may be, for example, electronic chips which, in particular, are biologically degradable. Films in the context of the present invention comprise, in particular, chips which monitor, regulate and/or control physiological effects. The films may also be used as in vivo or in vitro markers for checking and verification purposes.

It was surprising that an automated method is possible for the production of sheathed tablets which comprise a film. Surprisingly, the problems of the prior art were able to be overcome by means of the present invention. The production of sheathed tablets with films has hitherto been possible only by manual operation. By means of the present invention, films are made accessible for mechanical processing in sheathed tablets. It was entirely surprising that, with commercially available rotary tablet presses, sheathed tablets can be produced which do not contain as the core a tablet, but instead, in particular, a film in the context of the present invention. It turned out to be advantageous that quantities can be implemented which allow an economically viable production of sheathed tablets with, in particular, films or electronic chips. It has not been possible hitherto to introduce films or electronic chips into a tablet by a continuous method in an automatically controlled and monitored manner.

The films capable of being processed by means of the present invention are, in particular, in comparison with the cores in the production of standard sheathed-core tablets, very lightweight, with very small dimensions, unstable, elastically deformable and/or electrostatically chargeable. It is advantageous that even films which stick to one another under increased atmospheric moisture can be processed. That is to say, films can be sheathed which are freely movable in space under the least possible air circulations and/or which, under the least possible electrostatic charge, remain stuck to all objects which touch them. It was entirely surprising that, by means of the present invention, such diverse shaped bodies can be introduced into the die of a tablet press. It is this very multiplicity of differently configured films in terms of size, shape, nature, weight and appearance which constitutes a substantial advantage in comparison with the prior art. These various films have not hitherto been accessible for insertion into a tablet press by means of the devices and methods of the prior art. In particular, films in which delivery as bulk material is ruled out can be processed, for example, by means of the present invention. It was entirely surprising that vibrators or centrifugal conveyors were able to be dispensed with during the feed of the films to the tablet press and during introduction into a die.

It turned out to be advantageous that, in the method for the transfer, for the insertion and for the positioning of films, which are used as the core for sheathed-core tablets, in dies of tablet presses, the films are first provided by means of module 1. For this purpose, module 1 brings the films into the take-over position where the films are taken over by module 2.

For the provision of the films, it turned out to be advantageous if the films are delivered in a shaped carrier strip made from plastic on a carrier strip reel comparable to a cinematographic film reel. This carrier strip has shaped, for example deep-drawn, depressions in which a film is located in each case. The carrier strip made from plastic is provided, for example, with a self-adhesive cover strip, so that the films cannot fall out. One side of the carrier strip is perforated for unwinding and positioning the rolled-up carrier strip in the same way as a cinematographic film strip. Module 1 comprises, for example, a device which can receive up to 1000 carrier strip reels, preferably up to 100 carrier strip reels and most preferably up to 10 carrier strip reels with carrier strips.

To provide the films, the carrier strip is threaded, for example, into what is known as a feeder which automatically detaches the self-adhesive cover strip and winds it up and, motor-driven, brings a film into the take-over position, for example, every 1.5 seconds. In order to increase the rate of conveyance per unit time, a plurality of feeders may be arranged next to one another in a row. If, for example, there are ten feeders, ten films can be provided, for pick-up by module 2, every second, in particular discontinuously, for example in a clocked manner.

It is preferable, further, that, instead of the carrier strip, the films are delivered by means of one or more film trays. The films are then punched out of the film tray, for example either individually or severally, directly before provision, are brought into the take-over position by means of module 1 after being punched out and are provided for pick-up by module 2.

In a further preferred embodiment of the method, preferably ten carriers are provided in the transfer region of module 1 as a result of the interaction of counter sensors and stoppers. It was entirely surprising that the carriers for transporting the films can be provided discontinuously and then, further on in the production process, can be fed continuously to module 3 of the rotary press. In particular, the provision of the film by module 1 also takes place in a clocked or discontinuous manner.

It is preferable if the method steps of provision of the films by means of module 1 and/or take-over of the films by module 2 are discontinuous. Thus, it has turned out to be advantageous if the films, for example after they have been provided by means of module 1, are taken over in a clocked manner by module 2. However, the present invention also embraces, for example, a continuous provision of the films and a continuous take-over of the films by module 2. Module 2 comprises a suitable pick-up element for taking over the films from module 1. This pick-up element is, for example, a "pick and place" unit which takes over the films provided by module 1.

It is advantageous if the "pick and place" unit of module 2 comprises an extendable arm and a take-over head with, for example, 10 suction heads. To take over the films, the arm of the "pick and place" unit is brought into a position such that the take-over head of the "pick and place" unit with the 10 suction heads is located directly above the films provided by module 1. The films are provided, in particular, by means of 10 feeders arranged in a row, so that 10 films can be taken over simultaneously. By means of a vacuum, the films are sucked up by the suction heads of the "pick and place" unit. The diameter of the suction heads on the contact surface with the film corresponds approximately to the diameter of the films. As a result of the vacuum, the films lie over their entire area on the end face of the suction head and are not deformed. The contact surface may have a shallow lathe-turned indentation in order to center the films additionally. The take-over head of the "pick and place" unit of module 2 lifts the films out of the carrier strip and brings the films to, for example, ten carriers which stand ready and which are located on a conveyor belt 1.

It is preferable if at least one conveyor belt with at least two paths is used, and the pick-up element of module 2 alternately charges the carriers on path 1 and path 2 with films. The films are transferred from the suction heads of the "pick and place" unit (pick-up element) of module 2 to the carriers by the films being deposited in the reception bores of the carriers. In this case, the films are centered on the carriers. The reception bores of the carriers are slightly conical, so that further centering of the films is ensured. Preferably 10 carriers are loaded simultaneously with films. After the loading of the carriers which are located on path 1, the carriers loaded with films are preferably checked by sensory means. This monitors whether all the carriers are also actually loaded with a film. As soon as the 10 carriers are equipped, a stopper opens the path 1 and the 10 carriers are moved in the direction of module 3 by means of the permanently running flexible conveyor belt 1.

It is advantageous that, after the loading of the carriers located on path 1 of the conveyor belt 1, further carriers on path 2 of the conveyor belt 1 can be brought into the take-over position of module 2. The carriers on path 2 are consequently ready to be loaded with films. For this purpose, the "pick and place" unit of module 2 takes over the next 10 films from module 1 and transfers the films to the carriers which are located in the take-over position on path 2 of the conveyor belt 1. After these carriers on path 2 have been loaded, these loaded carriers are likewise moved in the direction of module 3 by means of the permanently running flexible conveyor belt 1. Thus, at the rate of seconds, in each case 10 carriers on path 1 and path 2 are equipped with films in succession. Downstream of the loading station, two optical sensors check whether all the carriers in path 1 and path 2 are equipped with films.

It is preferable that, when a two-track conveyor belt is used, the carriers of both paths are converged to one path and, in the absence of loading of the carriers with a film, the carriers are pushed by means of a switch onto a second conveyor belt which provides the empty carriers for renewed loading of the carriers with films.

It is preferable if the carriers are composed of high-grade steel so that they stand with the necessary weight on the conveyor belt in a stable manner. The inserts on the upper part of the carriers are made, in particular, from white FDA-licensed plastic. The films, in turn, have, for example, a dark coloring, so that there is a marked contrast with the white inserts. This makes it easier for the sensors to detect the inserted films reliably. Should films be absent in individual carriers, a message to this effect is given and it can be checked whether the fault lies at the feeders of module 1 or at individual suction heads of the "pick and place" unit of module 2.

It turned out to be advantageous that the loaded carriers are transported in the direction of module 3 by means of the conveyor belt 1. It is advantageous that the conveyor belt 1 is arranged such that, on the conveyor belt side lying opposite the "pick and place" unit, the carriers of both paths 1 and 2 are built up and are alternately released onto a path or converged. The clocked transport of the carriers is thereby changed to continuous transport.

It is preferable if module 2 comprises an intake wheel which sets a spacing between the carriers and transfers the carriers with the films to module 3 continuously. It is advantageous that module 3 operates continuously in contrast to the feeders of module 1 and to the "pick and place" unit of module 2. Module 3 constitutes, in particular, a film pressing-in module which runs synchronously and continuously with the rotor of the tablet press. It is advantageous that module 2 implements compensation between the clocked operation of the film take-over of module 1 and the continuous operation of film transfer by module 3 to the tablet press. Preferably, the films are taken over by the pick-up element of module 2 in a clocked manner and are inserted into the dies of the tablet press by module 3 in a continuous operation.

It is preferable, further, that the films are guided centrically from take-over from the pick-up element of module 2 to insertion into the dies of the tablet press by means of carriers or are transported to the vacuum heads by centric form fit.

It is preferable, furthermore, if a further conveyor belt 2 is present in addition to the conveyor belt 1. The two conveyor belts are connected to one another, for example, via a switch. Located upstream of the switch in relation to the conveyor belt 2 is a further optical sensor which checks the presence of a film on the carrier. If there is no film present in the reception bore of the carrier, the carrier is pushed from the conveyor belt 1 onto the conveyor belt 2 and is automatically transported back to the loading station via a second switch. The loading station is the station where the films are transferred to the carriers by means of the "pick and place" unit. Thus, only loaded carriers are led further on continuously to module 3, what is known as the take-over and pressing-in station.

It turned out to be advantageous if module 2 comprises an intake wheel and an output wheel. By means of the depressions in the intake wheel, the carriers are brought to the sample spacing of the take-over/transfer heads of module 3. Between the intake wheel and the output wheel, the take-over/transfer heads of module 3 take over the transport of the carriers. As in the case of the "pick and place" unit of module 2, module 3 also comprises suction heads. By means of a control cam, the suction heads move downward and take over the films from the carriers by means of a vacuum. It is preferable that the films are centered during take-over by module 3. It is preferable, further, that empty carriers are fed to module 2, after the extraction of the films by module 3 or by suction extraction, by means of at least one output wheel and are provided for renewed loading with films.

It is preferable that sensors check the extraction of the films from the carriers by module 3. It is also preferable that a film is sucked away which has not been extracted by module 3 and is still located in the carrier after passing module 3. At module 3, too, the contact surface of the suction heads corresponds to the diameter of the films. After the vacuum heads (suction heads) of module 3 have extracted the films from the carriers, the vacuum heads (suction heads) with the films are moved upward again. The empty carriers are transferred to the output wheel and are fed to the conveyor belt 1. Located here is an optical sensor which checks whether a film has remained in the carrier and has possibly not been taken over by the suction heads of module 3. Should that be the case, the film which has remained in the carrier is sucked away automatically by means of a nozzle. This prevents the situation where a carrier with a film arrives at the loading station and could be equipped with an additional film there.

It is preferable if the vacuum heads of module 3, in the position, lying opposite the take-over by module 2, on the reference circle of the die of the tablet press, move concomitantly with the die position in a synchronous manner. After the vacuum heads of module 3 (take-over/transfer module for inserting the films into the dies of the tablet press) have taken over the films from the carrier, the movable arms move toward the die plate of the tablet press (rotary press). The rotational speed of module 3 is controlled synchronously by means of the rotor speed of the tablet press. When the arms of module 3 reach the reference circle of the tablet press (rotary press) so as to overlap it, they are drawn back via a control cam, so that the vacuum heads with the films are located above the die bores over a certain region on the reference circle of the rotary press. The heads are pressed downward by means of a control cam, so that the vacuum heads with the films penetrate into the die bores and can thus press the films, in particular, into the pressing material of a first powder layer. The vacuum is switched off and a subsequent slight compressed air pulse ensures that the films do not remain adhering to the suction head. The vacuum heads then leave the die bores and are moved back onto the old reference circle via the control cam, and the vacuum lines are blown free by means of a strong compressed air pulse and subsequently take over the next films from the carriers. The films are thus inserted individually into the dies of the tablet press.

For the production of sheathed tablets in which a film is sheathed with compressed powder, it is preferable if the tablet press comprises two powder filling appliances and two pressure stations. It is advantageous if a pressure station is located in each case on the left and on the right of module 3. By means of the pressure station 1, the powder (pressing material), previously placed in the die, of the first layer is pressed slightly in order to deaerate the material and obtain a smooth surface. The film is subsequently introduced into the die automatically and continuously via module 3. It is preferable that the films are inserted centrically into the dies of the tablet press.

Preferably, the turntable of module 3 operates synchronously with the working speed of the rotor of the tablet press, so that the films are inserted continuously into the dies. The films are deposited on the first compressed powder layer. By means of the second pressure station, the film is pressed slightly and pressed into the first powder layer. In this case, by means of the second pressure station, the first layer with the inserted film is simultaneously pushed into the filling position for the second powder layer. This gives rise to a filling space for the second powder layer (cover layer). The cavity which has arisen is then filled by means of the second filling shoe and, for example, with the same pressing material as when the first powder layer was placed in the die. The pressing material is subsequently pressed into a sheathed tablet by means of the top and the bottom ram and with the aid of the prepressing force and main pressing force. The sheathed tablet is ejected and is conducted out of the tablet press by means of the tablet stripper via the discharge chute. It is advantageous that insertion of sensitive films into the dies of a tablet press in order thereby to embed the films in a sheathed tablet no longer has to take place by hand, as in the prior art, but instead can proceed in an automated manner by the method according to the invention being carried out. This advantageously leads to efficient processes in which the quality is reproducible and an increase in efficiency is achieved.

Further advantageous measures are contained in the remaining subclaims. The invention is now described by way of example with reference to the figures. The examples and figures are preferred design variants which do not restrict the invention.

FIG. 1 module 1

FIG. 2 module 2

FIG. 3 module 3

Figure 4:
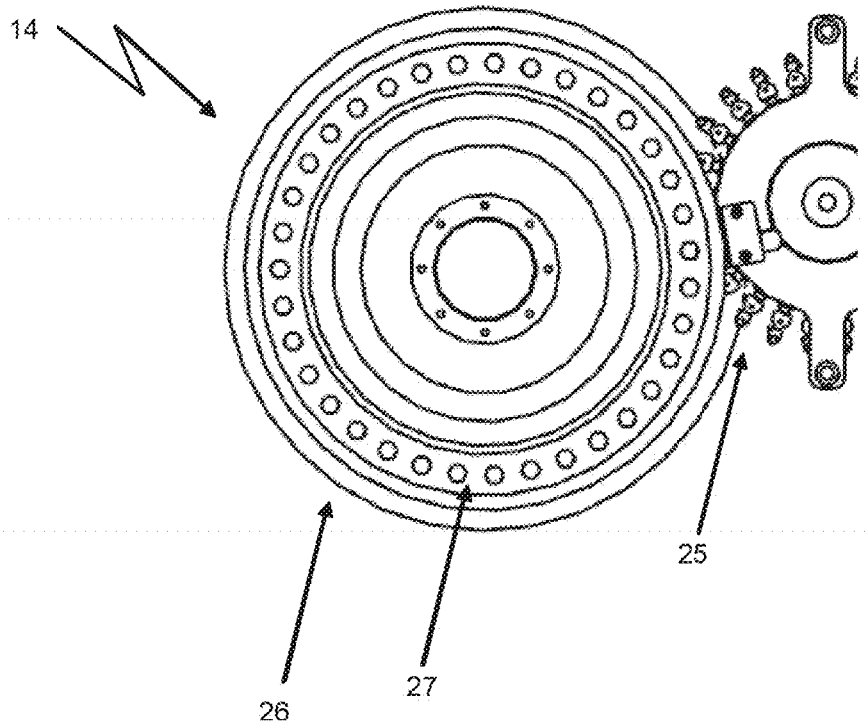

FIG. 4 tablet press

FIG. 5 apparatus comprising module 1, module 2, module 3 and tablet press

Figure 6:
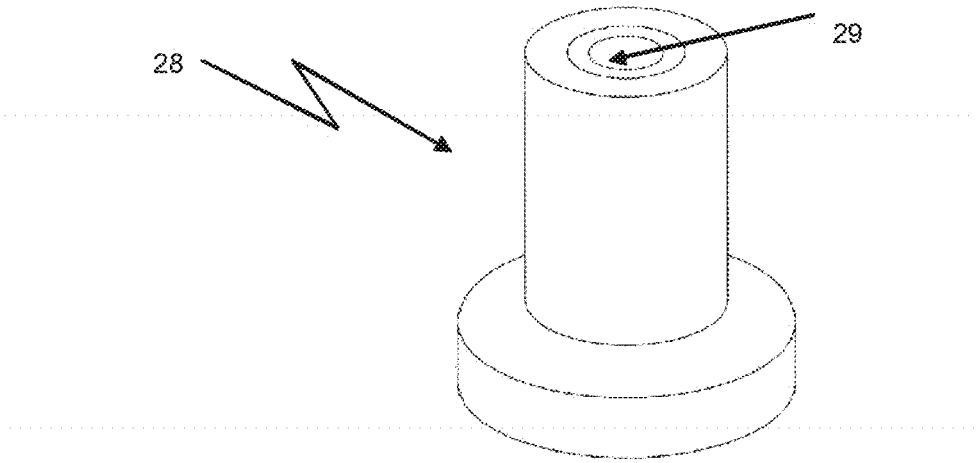

FIG. 6 carrier with reception bore

FIG. 1 shows a top view of module 1 (11), in particular a feeder (15), in which, for example, 10 formed carrier strips for the films are arranged next to one another, so that 10 films can be taken over simultaneously by module 2 (12). Module 1 (11) comprises a storage space for the reception of the carrier strips. The carrier strips with the films can be brought out of this storage space manually or automatically via an orifice into the position where the films are taken over by module 2 (12). When the carrier strip is being unrolled, in particular, the cover film over the formed, for example deep-drawn, depressions, in which the films to be sheathed are located, is drawn off. The films thereby become accessible for take-over by module 2 (12) and are thus provided. For the take-over of the films by module 2 (12) and, in particular, by the "pick and place" unit (16) of module 2 (12), it has turned out to be especially advantageous if module 1 (11) is of variable height and can be docked onto module 2 (12), and direct contact between the provision unit of module 1 (11) and the "pick and place" unit (16) of module 2 (12) can thereby be made.

FIG. 2 shows a top view of module 2 (12) which comprises, for example, a "pick and place" unit (16), conveyor belt 1 (17) with two paths (18*a*, 19), intake wheel (22), output wheel (23), optical check sensors (20), conveyor belt 2 (21) and switches (24*a*, 24*b*). Module 2 (12) preferably comprises a capacity for, for example, 300 carriers (28). By means of module 2 (12), the films are taken over from module 1 (11), placed on carriers (28) and transported to module 3 (13) on the carriers (28) with the aid of the conveyor belt 1 (17).

After the films have been provided by module 1 (11), for the take-over of the films by module 2 (12) a take-over arm is extended and is preferably placed directly over the provided films. The take-over arm preferably comprises, for example, 10 suction heads, by means of which ten films can be sucked up simultaneously by means of the vacuum. The take-over arm is an integral part of the "pick and place" unit (16). The take-over arm is extendable and is rotatable horizontally over, for example, 360°, preferably 180°. Moreover, a take-over arm is extendable in the vertical direction of space and can be set variably. After the films have been sucked up by module 2 (12) by means of the suction heads of the take-over arm of the "pick and place" unit (16), the method and apparatus of the present invention are programmed, in particular, such that the films are transferred to preferably ten provided carriers (28), in particular, via an automatic process.

The carriers (28), before being provided, have been checked by sensory means (30) as to whether the carriers (28) are not already loaded with a film. Only empty carriers (28) are provided for loading with films. After loading, a stopper (36) which interacts with the counter sensor (32) is opened, and the carriers (28) loaded with films are moved on the permanently running conveyor belt 1 (17). In FIG. 2, the running direction of the conveyor belt 1 (17) and therefore of the carriers (28) is intended, in particular, to be counterclockwise. Furthermore, in module 2, imaging sensors (33, 34) are provided, which check the loading of the carriers (28). Here, in each case an imaging sensor (33 or 34) is provided for a conveyor belt (17 or 19). The checking of the loading of the carriers (28) is a quality control measure. Using preferably two imaging sensors (33, 34) which are preferably designed as cameras, it is possible, in conjunction with the counter sensors (31, 32), to determine which carrier (28) is not correctly loaded and which feeder of module 1 (11) is, where appropriate, responsible for this. This is advantageous particularly because, in the event of repetition, not all feeders have to be exchanged "on suspicion", but only that feeder of which it is known that it has repeatedly caused incorrect loadings of the carriers (28).

Preferably ten carriers (28) are provided with films in the "pick and place" unit (16). The counter sensors (31, 32) count off this number of carriers (28) from the stream of carriers (28) arriving. Sensors which can be used for counting off articles are known to an average person skilled in the art. In this case, the counter sensors (31, 32) interact with stoppers (36, 37) which can stop carrier transport.

Before the loading of the carriers (28) in the "pick and place" unit (16), the stopper (37) which interacts with the counter sensor (32) is closed. Carriers are then fed to the transfer region (39) of the "pick and place" unit (16). The counter sensor (31) counts the carriers (28) arriving. When preferably ten carriers (28) are located in the transfer region (39) of the "pick and place" unit (16), the stopper (36) which interacts with the counter sensor (31) is closed and the carriers (28) are provided with the films. As a result of the time-delayed opening of the stoppers (36, 37) which interact with the counter sensors (31, 32), in each case after preferably ten carriers (28) a gap, into which the stopper (37) can engage, is made between the carriers (28). It is necessary for a gap to be made, since the stopper (37) has to engage between the carriers (28) in continuous operation. The stopper (36) comes to a standstill between a tenth and an eleventh carrier (28).

Module 2 (12) has, in particular, guide rails, in order to ensure that the carriers (28) cannot leave the conveyor belt 1 or 2 (17, 21) during transport. By means of guide rails on the flexible conveyor belt (17, 21), it also becomes possible, for example, that the carriers (28) can follow changes in direction of the conveyor belt 1 or 2 (17, 21) during transport. For example, the conveyor belt 1 (17) is arranged such that two horizontal changes in direction through 90° are executed on the way to module 3 (13).

FIG. 2 shows, at the position of the switch 24*b*, the transition from the conveyor belt 1 (17) to the conveyor belt 2 (21). This illustrates the position where faulty non-loaded carriers (28), detected by sensory check (20), are sorted out and are delivered via the conveyor belt 2 (21) for new loading at the position of the "pick and place" unit (16). The sensor (20) thus controls the deflection of faulty non-loaded carriers onto the conveyor belt 2 (21). Only correctly and fully loaded carriers (28) are therefore fed to the intake wheel (22) and further on to module 3 (13). The conveyor belt 2 (21) is also designated in the context of the invention as a bypass. Further, the lock-out region is likewise provided with an imaging sensor (35). It may also be gathered from FIG. 2 that the two paths 18*a*, 19 of the conveyor belt 1 (17) are converged into the path 18*b* upstream of the carrier transfer to module 3 (13). Further, the carriers (28) are built up before transfer to module 3 (13), and a defined spacing between the loaded carriers (28) is then set via the intake wheel (22). What is achieved thereby is that the carriers (28) have exactly the spacing which is necessary to ensure that the take-over/transfer heads (25) of module 3 (13) can take over the films from the carriers (28).

FIG. 3 shows a top view of module 3 (13). Module 3 (13) is what is known as the take-over and pressing-in unit. The films are thereby extracted from the carriers (28). The take-over/transfer heads (25) shown in FIG. 3 comprise vacuum suction heads which suck up the films from the carriers (28). The take-over and pressing-in unit (module 3) (13) is rotatable, in particular, about an axis parallel to the axis of the die table (26) of the tablet press (14). Module 3 (13) comprises, in particular, a rotor which is provided with radial arms and in the head parts of which are mounted radially movable take-over/transfer heads (25) which can be brought into congruence with the dies for the transfer of the films. Module 3 (13) is rotatable and is capable of having the same rotational speed as the tablet press (14). By means of module 3 (13), the films are inserted into the die orifices of the tablet press (14). For this purpose, the take-over/transfer heads (25) of module 3 (13), for example vacuum heads, can be positioned directly above or in the die orifices of a tablet press (14), in order to insert the films. The take-over/transfer heads (25) are, in particular, adjustable vertically by means of control cams. Moreover, the take-over/transfer heads (25) can be moved in horizontally in order to bring them into congruence with the die orifice. Centric positioning of the films in the die of a tablet press (14) with an exact fit is thereby possible.

FIG. 4 shows a top view of a tablet press (14) with top ram heads (27) which, in particular, penetrate into the die orifices, in order to compact the powder and thus sheath the inserted film. The tablet press (14) which serves for the production of sheathed tablets comprises a rotary-driven die table (26) with dies arranged on a reference circle. Further, the tablet press (14), which is suitable for the production of sheathed tablets with inserted films, comprises in the sheathed core version, on the reference circle of the die table (26), not only one, but, in particular, two filling appliances for powder. These two powder filling appliances contain the powder with which the film is sheathed in the sheathed tablet. By means of one powder filling appliance, powder is previously placed in the die, the film is then inserted, and finally the film is covered by means of the second powder filling appliance. For example, it is also possible that the powder filling appliances contain different types of powder, if this is necessary. After the filling of the die with powder, with the film by means of module 3 (13) and again with powder, the actual pressing operation follows, by means of which the tablet comprising a sheathed film is produced.

FIG. 5 shows, for example, how modules 1 (11) to 3 (13) and the tablet press (14) can be connected to one another or arranged in order to extract the films from the storage container or storage magazine and finally insert them into the tablet press (14). Preferably, the individual modules are height-adjustable or are coordinated with one another in height. The apparatus in FIG. 5 can be adapted individually in its capacity to the required throughput in the insertion of the films into the tablet press (14), for example, by means of an additional length of the conveyor belts (17, 21), a larger number of carriers (28), a plurality of carrier strips in the feeder (15) of module 1 (11), the number of take-over heads in the "pick and place" unit (16) and, for example, the number of paths.

FIG. 6 shows, for example, a carrier (28) with a reception bore (29) for the film. The carriers (28) are preferably manufactured from high-grade steel. The advantage of this is that the carriers (28) have a weight which allows stable transport on the conveyor belt (17, 21). It is preferable, further, that the carriers (28) also comprise plastic. The plastic part of the carriers (28) is, in particular, the contact surface between the film and the carrier (28). The carrier (28) has on the contact surface a reception bore (29) for the film, as a result of which the film is centered and, because of the recess (9), cannot fall from the carrier (28) even during transport, but instead is guided in a centered manner.

REFERENCE SYMBOLS

11 Module 1
12 Module 2
13 Module 3
14 Tablet press
15 Feeder
16 Pick and place unit (pick-up element)
17 Conveyor belt 1
18*a* Path 1
18*b* Path 1
19 Path 2
20 Sensor for the control of lock-out
21 Conveyor belt 2

22 Intake wheel
23 Output wheel
24*a* Switch
24*b* Switch
25 Take-over/transfer heads (vacuum heads) of module 3
26 Die table
27 Top ram
28 Carrier
29 Reception bore
30 Sensor for the check of loading
31 Counter sensor (initiator)
32 Counter sensor (initiator)
33 Imaging sensor, in particular camera
34 Imaging sensor, in particular camera
35 Imaging sensor, in particular camera
36 Stopper which interacts with the counter sensor 31
37 Stopper which interacts with the counter sensor 32
38 Stopper
39 Transfer region between module 1 and module 2

The invention claimed is:

1. A method for transfer, insertion and positioning of films, which are used as a core for sheathed-core tablets, in dies of tablet presses, wherein the method comprises the following method steps, a) provision of the films via a first module which brings the films into the take-over position, b) provision of ten carriers in the transfer region between the first module and a second module as a result of an interaction of counter sensors and stoppers, c) take-over of the films by the second module, the second module receiving the films by a pick-up element via vacuum heads, d) placing of the films on carriers by the second module, the films being centered on the carriers, e) transport of the carriers to a third module, loading of the carriers being checked in a sensory manner by imaging sensors, f) take-over of the films by the third module via vacuum heads, and g) positioning of the films in dies of the tablet press, the films being inserted.

2. An apparatus for transfer, insertion and positioning of films, which are used as cores for sheathed-core tablets, in dies of tablet presses, wherein the apparatus comprises at least three modules, a) a first module, comprising at least one storage unit, which contains the films, and/or at least one provision unit, which provides the films for take-over by a second module, b) the second module, comprising at least one take-over unit, at least one first conveyor belt, at least one second conveyor belt, a pick-up element, carriers, imaging sensors, counter sensors, and at least one intake wheel, the second module i. taking over the films from the first module via a pick-up element, ii. placing the films on the carriers, iii. transporting the carriers, iv. checking loading of the carriers via the imaging sensors and/or detecting the number of carriers in a transfer region between the first module and the second module via the counter sensors, faulty non-loaded carriers being sorted out onto the second conveyor belt and being delivered for new loading with films, v. setting a spacing between the carriers via the intake wheel, c) a third module, comprising at least one controllable vacuum head comprising an extraction device which extracts the films from the carriers of the second module via a vacuum and inserts them into the dies of the tablet press.

3. The method as claimed in claim 1, wherein the films are an information carrier, a separating layer and/or an active substance carrier, the films being lightweight, flexurally slack, pliant, flexible, rigid and/or chargeable.

4. The method as claimed in claim 1, wherein the method steps of provision of the films the first module and/or take-over of the films by the second module are discontinuous.

5. The method as claimed in claim 1, wherein the second module comprises an intake wheel which sets a spacing between the carriers and transfers the carriers with the films to the third module continuously.

6. The method as claimed in claim 1, wherein the films are taken over by the pick-up element of the second module in a clocked manner and are inserted into the dies of the tablet press by the third module in a continuous operation.

7. The method as claimed in claim 1, wherein at least one conveyor belt with at least two paths is used, and the pick-up element of the second module alternately charges the carriers on path 1 and path 2 with films.

8. The method as claimed in claim 7, wherein, when a two-path conveyor belt is used, the carriers of both paths are converged to one path and, in the absence of loading of the carriers with a film, the carriers are pushed by means of a switch onto a second conveyor belt which provides the empty carriers for renewed loading of the carriers with films.

9. The method as claimed in claim 1, wherein the films are guided centrically by means of carriers or transported on the vacuum heads by means of a centric form fit from take-over of the take-over unit of the second module to insertion to the dies of the tablet press.

10. The method as claimed in claim 1, wherein the vacuum heads of the third module move synchronously with the die position in the position, lying opposite the take-over by the second module, on the reference circle of the die of the tablet press.

11. The method as claimed in claim 1, wherein empty carriers are fed to the second module, after the extraction of the films by the third module or by suction extraction, by means of at least one output wheel and are provided for renewed loading with films.

12. The apparatus as claimed in claim 2, wherein the second module comprises the following units which are selected from the group comprising take-over units, pick-up elements, conveyor belts, deflecting wheels, guide rails, spacers, stoppers, check sensors, intake wheels, output wheels and/or switches.

13. The apparatus as claimed in claim 2, wherein the take-over unit of the second module comprises as pick-up element a take-over head with up to 50 vacuum heads.

14. The apparatus as claimed in claim 2, wherein the third module comprises vacuum heads, movable arms, at least two control cams, compressed air connections and/or vacuum connections, the vacuum heads being lowerable and penetrating into the dies of the tablet press.

15. The apparatus as claimed in claim 2, wherein a rotational speed of the third module can be set variably and synchronously with the rotor speed of the tablet press.

16. The apparatus as claimed in claim 2, wherein the take-over unit of the second module comprises as pick-up element a take-over head with up to 30 vacuum heads.

17. The apparatus as claimed in claim 2, wherein the take-over unit of the second module comprises as pick-up element a take-over head with up to 20 vacuum heads.

18. The apparatus as claimed in claim 2, wherein the take-over unit of the second module comprises as pick-up element a take-over head with up to 10 vacuum heads.

* * * * *